US005191998A

United States Patent [19]

Schwarzli

[11] Patent Number: 5,191,998

[45] Date of Patent: Mar. 9, 1993

[54] BRUSH HOUSING FOR BULK VENDOR

[76] Inventor: Josef W. Schwarzli, Vandorf Road, R.R. #4, Stouffville, Ontario, Canada, L0H 1L0

[21] Appl. No.: 880,692

[22] Filed: May 8, 1992

[51] Int. Cl.[5] ..... G07F 11/00

[52] U.S. Cl. ..... 221/203; 221/241; 221/265

[58] Field of Search ..... 221/200, 203, 204, 263-265, 221/241; 222/217, 239, 242, 345, 349, 367, 370

[56] References Cited

U.S. PATENT DOCUMENTS

| | | | |
|---|---|---|---|
| 964,782 | 7/1910 | Hull | 221/265 X |
| 2,664,227 | 12/1953 | Probasco | 221/265 X |
| 2,855,128 | 10/1958 | Cookson . | |
| 2,990,975 | 7/1961 | Sereno | 221/203 |
| 3,894,465 | 7/1975 | Eckmayr | 222/370 X |
| 4,534,492 | 8/1985 | Schwarzli . | |

*Primary Examiner*—David H. Bollinger
*Attorney, Agent, or Firm*—Ridout & Maybee

[57] ABSTRACT

A coin operated bulk vending apparatus is provided with brushes, preferably tension springs, extending over the aperture above the dispensing wheel. One end of each brush is anchored to a brush housing adjacent a periphery of the dispensing wheel, and the other end of each brush is anchored to an adjustable anchor disposed about the axle of the dispensing wheel. In a preferred embodiment the adjustable anchor comprises a notched bushing adapted to receive a moveable ring secured to the brushes. In a further embodiment the brushes are anchored to an invertible bushing. The brushes are preferably frustoconical in configuration to minimize gaps.

10 Claims, 4 Drawing Sheets

BRUSH HOUSING FOR BULK VENDOR

FIELD OF THE INVENTION

This invention relates to a coin operated vending machine. In particular, this invention relates to an improvement in the dispensing apparatus of a coin operated vending machine for dispensing bulk merchandise.

BACKGROUND OF THE INVENTION

Coin operated vending machines for dispensing bulk merchandise, so called "bulk vendors", are widely used to dispense small vendible items. Such machines were initially restricted to dispensing gumballs and like articles, which by virtue of their hard spherical configuration are ideally suited to be dispensed from a bulk vendor. However, more recently a wide variety of articles of various sizes can be found in bulk vendors of this type, including toys and confectioneries. Frequently such an article will be packaged in a rigid capsule of more or less spherical or spheroidal configuration.

The wide variety of articles now available to be dispensed from a bulk vendor has given rise to certain problems. In particular, bulk vendors are typically designed to accommodate articles of a certain size. Thus, in conventional bulk vendors a series of resilient springs, known as "brushes", extend radially above the dispensing wheel, over the dispensing aperture, and operate to deflect loose articles in the product bin away from the dispensing aperture, so that only the articles carried in one of the containers formed in the dispensing wheel will be dispensed with each coin inserted into the vendor. The brushes are fixed at a height above the dispensing wheel that permits articles in an advancing container to pass underneath the brushes, while articles resting on the dispensing wheel outside of the container are deflected over the brushes as the wheel advances.

Brushes of this design present a number of disadvantages. First, since the brushes are anchored only at their outer ends, the inner ends of the brushes are readily deflected by loose articles entrained in the flow of articles in the product bin. This can permit unintended access to the dispensing aperture resulting in a greater number of articles being dispensed than are carried in the container, with attendant costs to the operator. Moreover, since the brushes are anchored to the brush housing at a fixed height, designed according to the size of article intended to be dispensed, a bulk vendor so equipped will not readily dispense larger articles and will tend to over-dispense smaller articles which, although not seated in a container, may nevertheless squeeze under the brushes.

The present invention overcomes these disadvantages by providing means for adjusting the height of the brushes, that is the clearance between the brushes and the dispensing wheel. In a preferred embodiment such means may include a bushing engaged over the axle of the dispensing wheel having notches adapted to engage an adjusting ring to which the inner ends of the brushes are anchored. Thus, in accordance with the present invention the brushes are anchored at both ends, reducing the degree of both lateral and vertical deflection under the force of loose articles in the product bin. Moreover, the height of the brushes can be readily adjusted simply by manually disengaging the adjusting ring from a notch and re-engaging the ring in another notch in the bushing.

In a preferred embodiment of the invention the brushes are frustoconical, with the larger ends anchored to the brush housing and the smaller ends anchored to the locking ring. This minimizes gaps between brushes and helps to resist penetration between brushes by loose articles.

SUMMARY OF THE INVENTION

The present invention thus provides a coin operated bulk vending apparatus for dispensing articles comprising storage means for storing the articles, a dispensing wheel advanced by a coin operated gear mechanism and having containers for advancing merchandise toward a dispensing aperture, and means for preventing loose articles in the storage means from accessing the dispensing aperture comprising resilient members extending over the dispensing aperture above the dispensing wheel having one end anchored adjacent to a periphery of the dispensing wheel and another end anchored to adjustable anchoring means disposed about an axis of the dispensing wheel.

BRIEF DESCRIPTION OF THE DRAWINGS

In drawings which illustrate by way of example only a preferred embodiment of the invention.

DETAILED DESCRIPTION OF THE INVENTION

Figure 1:
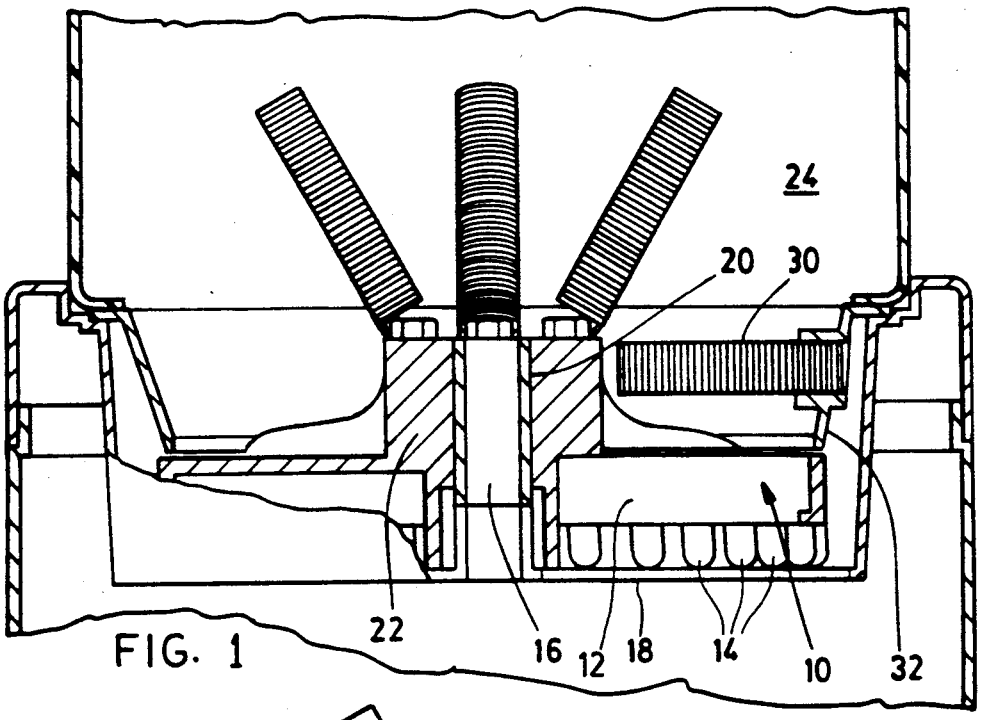
FIG. 1 PRIOR ART
FIG. 1 is a partial cross-sectional elevation of a conventional bulk vendor.
Figure 4:
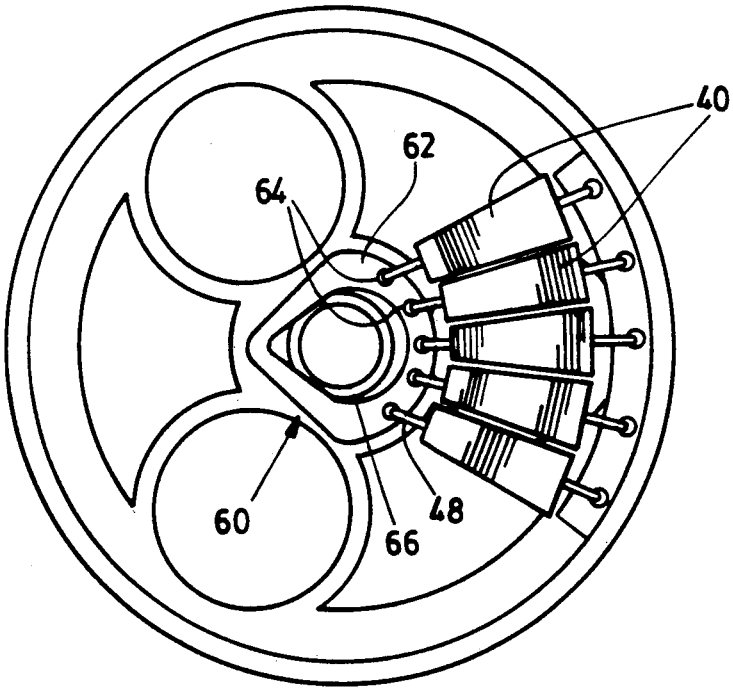
FIG. 4 is a top plan view of the embodiment shown in FIG. 2.

FIG. 1 illustrates a conventional dispensing wheel/-brush housing assembly having a dispensing wheel 10 including open-bottom containers 12 (as best seen in FIG. 4) for carrying merchandise to be dispensed, and teeth 14 engaged by a conventional coin operated gear mechanism (not shown). The dispensing wheel 10 revolves around an axle 16 disposed through the centre of the dispensing wheel 10. One complete revolution of the coin operated gear mechanism advances the next container 12 to a dispensing aperture 18 such that merchandise seated in the container 12 falls through the dispensing aperture 18 into a delivery chute (not shown). An agitator 20 is affixed to the hub 22 of the dispensing wheel 10 to agitate loose articles contained within the storage means comprising product bin 24.

In the conventional dispensing wheel/brush housing assembly illustrated in FIG. 1, a series of resilient springs or "brushes" 30 are anchored to an exterior brush housing 32 adjacent to a periphery of the dispensing wheel, and at a height above the dispensing wheel 10 corresponding to the size of articles to be dispensed. The height of the brushes 30 is selected to permit articles seated in a container 12 to pass under the brushes 30, while loose articles carried on the dispensing wheel 10 and revolving therewith (but not in a container 12) will be deflected over the brushes 30 as the dispensing wheel 10 advances. This allows only articles contained within a container 12 to be dispensed through the dispensing aperture 18.

Figure 2:
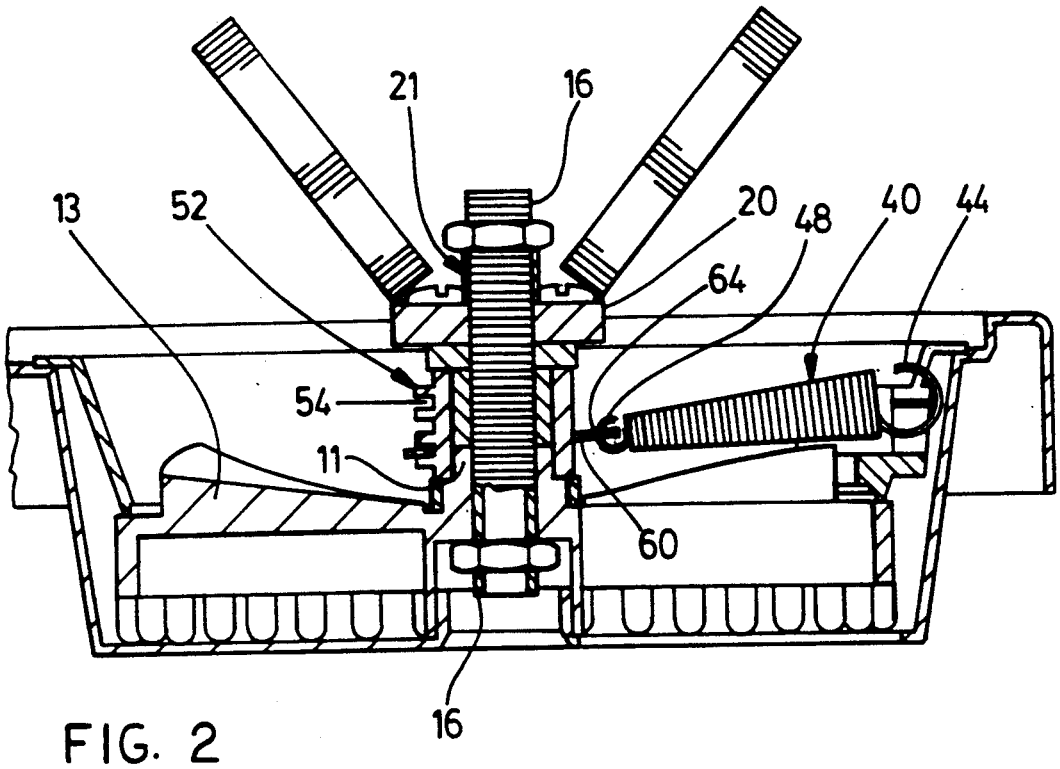
FIG. 2 is a cross-sectional elevation of a dispensing wheel/brush housing assembly illustrating the subject invention.
Figure 3:
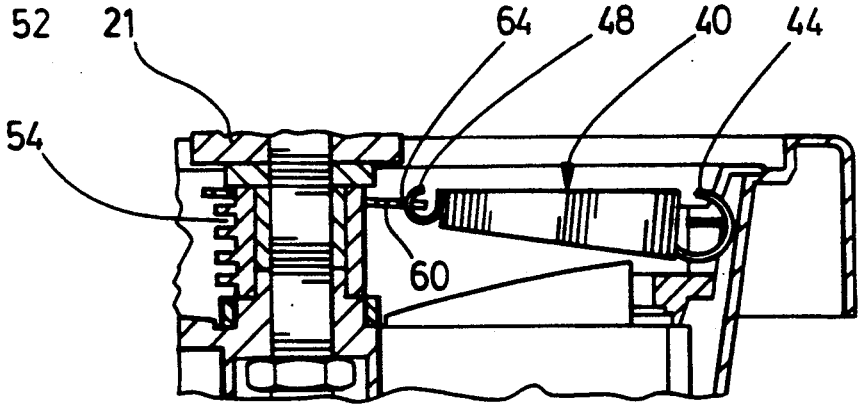
FIG. 3 is a partial cross-section showing the brushes mounted in an alternate position from that shown in FIG. 2.

In a preferred embodiment of the subject invention, illustrated in FIGS. 2–4, a series of brushes 40 comprising resilient members such as tension springs are anchored to the brush housing 42 in any conventional manner; in FIG. 2 each brush 40 includes a hook 44 which engages a hole in a flange 46 depending from the brush housing 42 above a periphery of the dispensing wheel 10. Each brush 40 preferably comprises a frustoconical tension spring, the frustoconical shape being preferred because it minimizes gaps between brushes 40, as can be seen in FIG. 4, and thus reduces the possibility that loose articles in the product bin will squeeze through the brushes 40 and be unintentionally dispensed.

The inner end of each brush 40 includes a hook 48 anchored to a hole 64 in adjustable anchoring means, which in the preferred embodiment comprises an adjusting ring 60 which is engaged around a bushing 52 having notches 54. The bushing 52 is engaged about the axis of the dispensing wheel 10, preferably over the axle 16 of the dispensing wheel 10, such that the axle 16 revolves within the bushing 52. Where the device includes an agitator 20, as shown in FIGS. 2–4, the bushing 52 is engaged over the hubs 11, 21 of the dispensing wheel 10 and agitator 20, which hubs interlock so that the agitator 20 revolves with the dispensing wheel 10. In this case the hubs 11, 21 revolve within the bushing 52, which remains stationary due to the tension of the brushes 40 on the adjusting ring 60. The bushing 52 includes flattened surfaces 52*a* which engage straight edges of the central opening in the adjusting ring 60, as best seen in FIG. 4, to prevent the bushing 52 from rotating within the ring 60. In this fashion the notches 54 remain oriented in a position opposite the brushes 40 as the dispensing wheel 10 advances.

The adjusting ring 60, best seen in FIG. 4, includes a tab 62 containing a series of holes 64 for engaging the hooks 48 at the small end of each brush 40. The generally central opening through the ring 60 is sufficiently large to permit the ring 60 to be manually moved to any notch 54 in the bushing 52.

FIG. 2 illustrates the dispensing wheel/brush housing assembly of the present invention with the adjusting ring 60 engaged in the lowermost position, for dispensing small articles from the bulk vendor. The tension of the brushes 40 on the tab 62 of the adjusting ring 60 retains the adjusting ring 60 in the selected notch 54. To adjust the height of the brushes 40, the operator simply grasps the tab 62 on the adjusting ring and pushes it toward the bushing 52 The adjusting ring thus disengages from its notch 54, and can be moved to another notch 54 according to the size of article desired to be dispensed. FIG. 3, for example, illustrates the dispensing wheel/brush housing assembly with the adjusting ring 60 in the highest position, for large articles. The number of possible positions is determined by the number of notches 54 in the bushing 52, which is limited only by the distance which the brushes 40 can be stretched before permanent deformation occurs.

It has been found advantageous to provide the dispensing wheel 10 with ramps 13, which causes articles seated on the dispensing wheel 10 to roll or slide toward and into a container 12. The ramps 13 thus incline downwardly toward each container 12, and also incline downwardly toward the centre enough to permit the ramps 13 to pass under the inner end of the brushes 40 in their lowermost position.

In operation, the purchaser deposits a coin into the coin operated gear mechanism and rotates the handle, which advances the dispensing wheel 10 such that the next container 12, carrying articles from the product bin, advances toward the brushes 40. As the dispensing wheel 10 revolves, articles seated on the dispensing wheel 10 (but not in a container 12) tend to advance toward the brushes 40, assisted by rotation of the agitator 20. Articles seated in the container 12 pass underneath the brushes 40, perhaps deflecting them slightly upwardly, and as the container 12 comes into alignment with the dispensing aperture 18 the articles seated therein fall through the dispensing aperture 18 into the delivery chute.

Meanwhile, articles entrained in the flow of product in the product bin 24 do not have sufficient clearance between the dispensing wheel 10 and the brushes 40 (the height of the brushes 40 having been selected to accommodate the specific size of the articles being dispensed) to follow the dispensed merchandise into alignment with the dispensing aperture 18; rather, these loose articles are deflected over the brushes 40 and are retained in the general flow of product in the product bin 24. As the next purchaser inserts a coin and turns the handle to advance the dispensing wheel 10, the empty container 12 (from which articles have previously been dispensed) advances out from underneath the brushes 40 and loose articles in the product bin fall into the empty container 12, while the next succeeding container 12 comes into alignment with the dispensing aperture 18. Both lateral and vertical deflection of the brushes 40 is minimal during this process, since the brushes 40 are anchored at each end 44, 48. Moreover, the likelihood of articles squeezing between the brushes 40 is very slight, because the frustoconical configuration of the brushes 40 almost eliminates gaps between the brushes 40.

Figure 6:
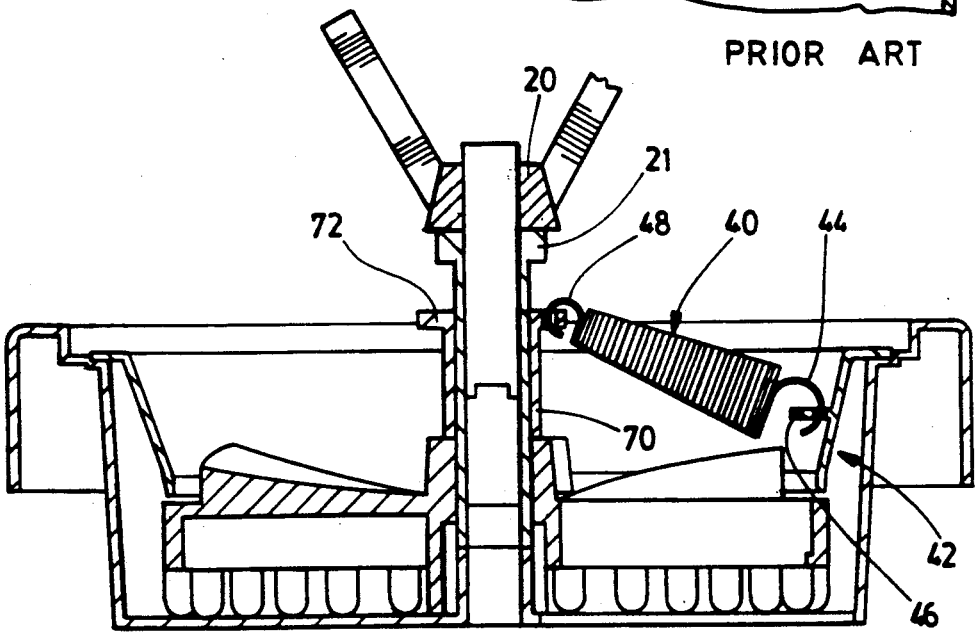
FIG. 6 is a partial cross-section of an alternate embodiment of the invention utilizing an invertible bushing.
Figure 5:
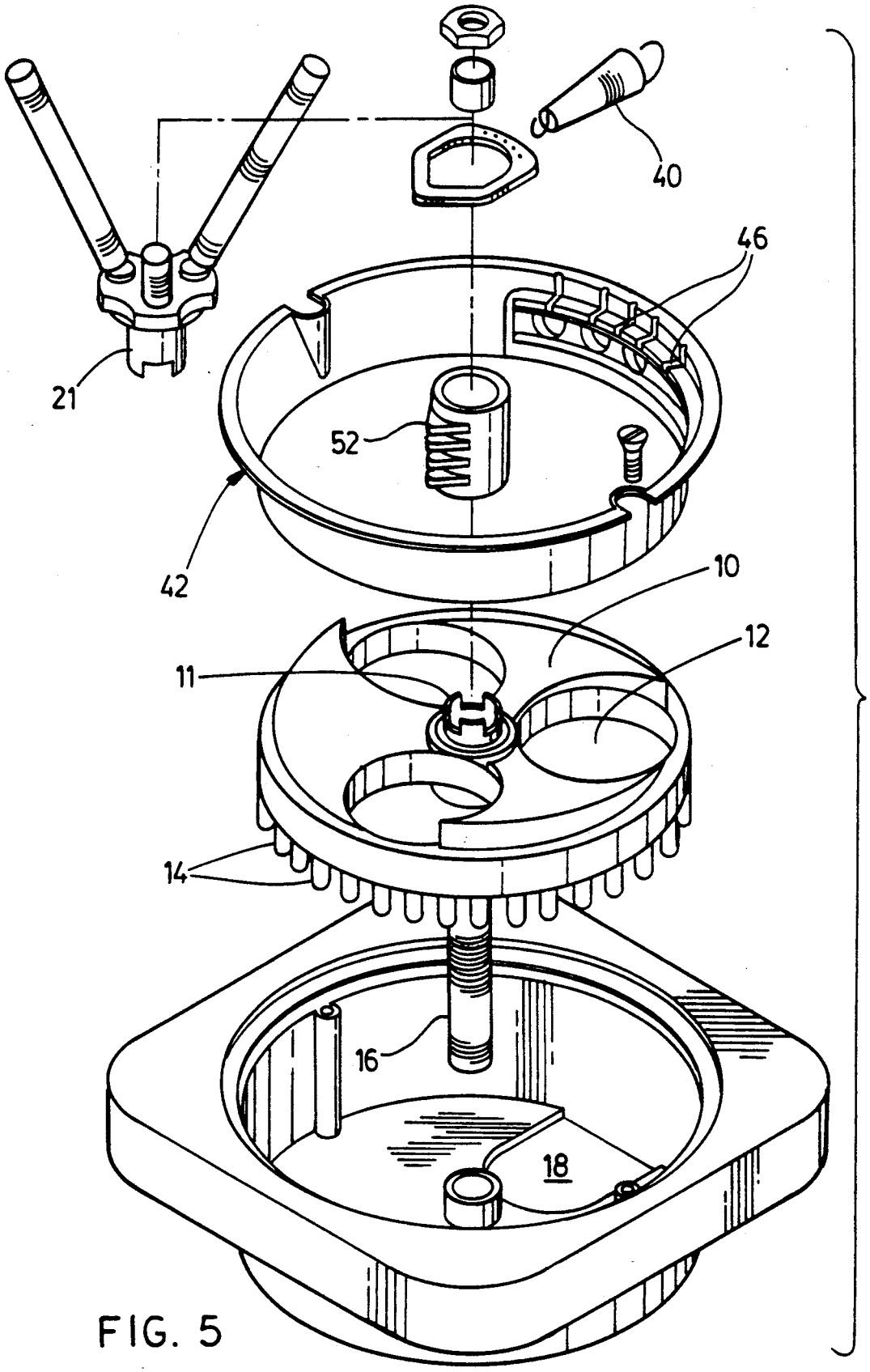
FIG. 5 is an exploded view of the dispensing wheel/-brush housing assembly of FIG. 2.
Figure 2A:
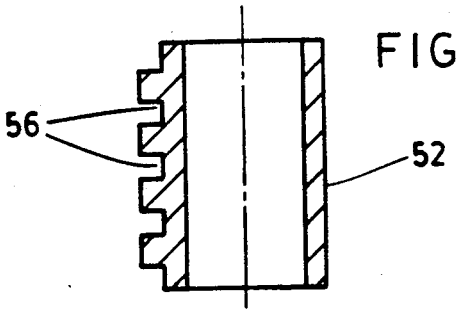
FIG. 2*a* is a cross-section of the bushing of the adjustable anchoring means.
Figure 2B:
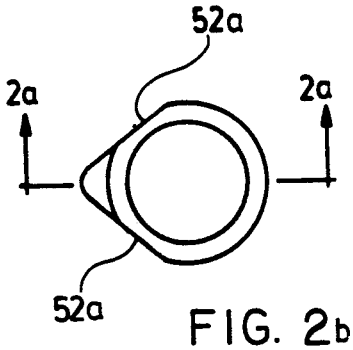
FIG. 2*b* is a top view of the bushing of FIG. 2*a;*
Figure 7:
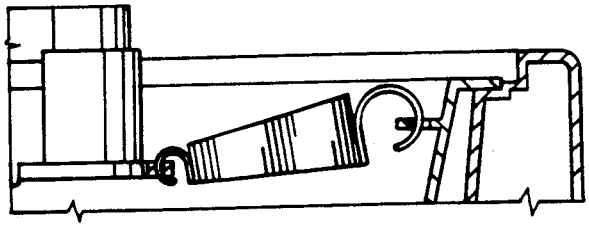
FIG. 7 is a partial cross-section showing the invention of FIG. 6 with the brush bushing inverted.

In an alternative embodiment of the subject invention, shown in FIGS. 5–7, adjustable anchoring means comprises a bushing 70 provided on one end with a flange 72 having holes for engaging the hooks 48 on the inner ends of the brushes 40, and mounted about the hubs 11, 21 of the dispensing wheel 10 and agitator 20, respectively. The height of the brushes 40 may thus be adjusted from an upper position, illustrated in FIG. 6, to a lower position, illustrated in FIG. 7, by removing the agitator assembly 20, disengaging the hooks 48 of the brushes 40 from their anchoring holes in the flange 72, inverting the bushing 70, re-engaging the hooks 48 of the brushes 40 into their corresponding anchoring holes in the flange 72, and finally reattaching the agitator assembly 20.

This embodiment provides only two possible heights for the brushes 40, and requires removal of the agitator assembly 20 and manual detachment and re-engagement of the hooks 48 of the brushes 40 to the bushing flange 72. Accordingly, the embodiment utilizing the adjusting ring 60 in conjunction with a notched bushing 52 is preferred, for the greater number of possible positions of the brushes 40 and the ease of changing from one position to another.

The invention having been described by way of examples of the preferred embodiment, it will be obvious to those skilled in the art that certain modifications and adaptations may be made to the invention without departing from the scope thereof as set out in the appended claims.

I claim:

1. A coin operated bulk vending apparatus for dispensing articles comprising a product bin for storing the articles, disposed above a dispensing wheel advanced by a coin operated gear mechanism and having containers for advancing the articles toward a dispensing aperture located beneath the dispensing wheel, and means disposed above the dispensing apparatus for preventing loose articles in the product bin from accessing the dispensing aperture, comprising resilient members extending over the dispensing aperture above the dispensing wheel having one end anchored adjacent to a periphery of the dispensing wheel and another end anchored to an adjusting ring adjustably engaged around a bushing disposed about an axis of the dispensing wheel, the bushing having means for releasably retaining the adjusting ring in a selected position.

2. An apparatus as defined in claim 1, wherein the adjusting ring includes a series of holes for generating hooks on inner ends of the resilient members and a central opening through which the busing is disposed.

3. An apparatus as defined in claim 2, wherein the bushing includes a plurality of notches for releasably retaining the adjusting ring in a selected position.

4. An apparatus as defined in claim 3, wherein the resilient members are frustoconical in configuration.

5. An apparatus as defined in claim 1, wherein the dispensing wheel is provided between containers with ramp portions inclining downwardly toward a centre of the dispensing wheel.

6. An apparatus as defined in claim 1, including an agitator engaged to a hub of the dispensing wheel and extending into the product bin for agitating loose articles in the product bin.

7. A coin operated bulk vending apparatus for dispensing articles comprising a product bin for storing the articles, disposed above a dispensing wheel advanced by a coin operated gear mechanism and having containers for advancing the articles toward a dispensing aperture located beneath the dispensing wheel, and means disposed above the dispensing apparatus for preventing loose articles in the product bin from accessing the dispensing aperture, comprising resilient members extending over the dispensing aperture above the dispensing wheel having one end anchored adjacent to a periphery of the dispensing wheel and another end anchored to adjustable anchoring means including an invertible bushing having means for anchoring the brushes thereto, disposed about the centre of the dispensing wheel.

8. An apparatus as defined in claim 7, wherein the resilient members are frustoconical in configuration.

9. An apparatus as defined in claim 7, wherein the dispensing wheel is provided between containers with ramp portions inclining downwardly toward a centre of the dispensing wheel.

10. An apparatus as defined in claim 7, including an agitator engaged to a hub of the dispensing wheel for agitating loose articles in the storage means.

* * * * *